US008721136B2

(12) United States Patent
Foss

(10) Patent No.: US 8,721,136 B2
(45) Date of Patent: May 13, 2014

(54) 10 FOOT MULTI DIRECTON SPLITTER LIGHT

(76) Inventor: Jacob Jon Foss, Poulsbo, WA (US)

( * ) Notice: Subject to any disclaimer, the term of this patent is extended or adjusted under 35 U.S.C. 154(b) by 153 days.

(21) Appl. No.: 13/464,883

(22) Filed: May 4, 2012

(65) Prior Publication Data

US 2012/0300478 A1 Nov. 29, 2012

Related U.S. Application Data

(60) Provisional application No. 61/482,778, filed on May 5, 2012.

(51) Int. Cl.

| | |
|---|---|
| ***F21V 21/00*** | (2006.01) |
| ***F21S 8/06*** | (2006.01) |
| ***F21S 2/00*** | (2006.01) |
| ***F21V 15/02*** | (2006.01) |

(52) U.S. Cl.

CPC ..... *F21S 8/068* (2013.01); *F21S 2/005* (2013.01); *F21V 15/02* (2013.01)

USPC ..... 362/391; 362/647

(58) Field of Classification Search

CPC ..... F21S 2/00; F21S 2/11; F21S 2/005; F21S 8/061; F21S 8/068; F21V 15/02; F21V 21/008; F21V 21/34; H02G 3/16; H02G 3/18

USPC ..... 362/145, 147, 391, 647

See application file for complete search history.

(56) References Cited

U.S. PATENT DOCUMENTS

| | | | | |
|---|---|---|---|---|
| 5,733,037 | A * | 3/1998 | Tennis et al. | 362/249.08 |
| 7,658,505 | B2 * | 2/2010 | Howell | 362/147 |

* cited by examiner

*Primary Examiner* — Stephen F Husar

(74) *Attorney, Agent, or Firm* — Galvin Patent Law LLC; Brian R. Galvin

(57) ABSTRACT

A construction lighting apparatus having a plurality of lighting modules, each comprising an electrical cord having approximately a 10 foot length, the electrical cord comprising an integral molded light source located midway, one end having a male electrical plug and the other end having a three-directional three-way female electrical outlet plug, the male electrical plug further having at least two pliable loops, the three-directional three-way female electrical outlet having at least two hooks. If two lighting modules are attached the pliable loops of the male electrical plug of one lighting module will be secured to the hooks of the three-directional three-way female electrical outlet of the other lighting module.

2 Claims, 1 Drawing Sheet

10 FOOT MULTI DIRECTON SPLITTER LIGHT

PRIORITY CLAIMS

Figure 1:
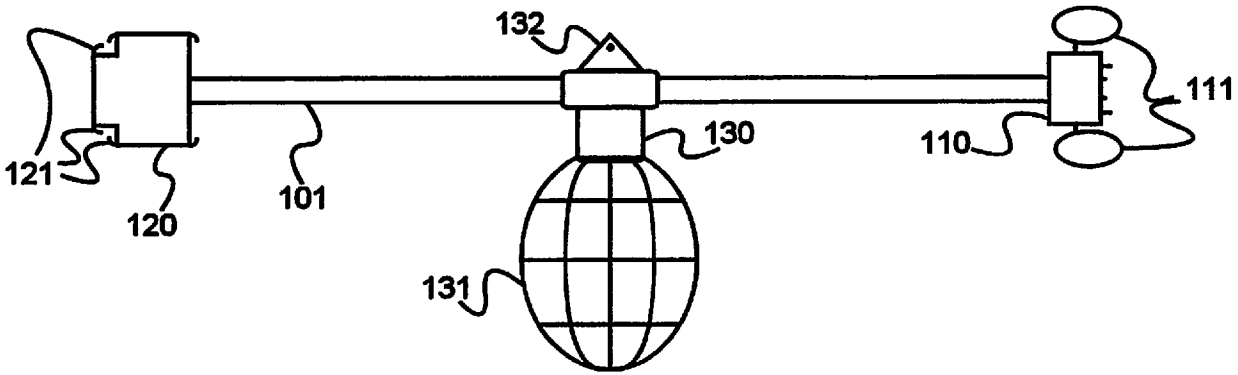

This application claims priority to U.S. provisional patent application Ser. No. 61/482,778, which was filed on May 4, 2012 and titled "10 foot multi direction splitter light", the entire specification of which is incorporated herein by reference.

BACKGROUND OF THE INVENTION

1. Field of the Art

The disclosure relates to the field of electrical power distribution, and more particularly to the field of electric cabling for use in for example construction sites.

2. Discussion of the State of the Art

At construction sites, for example, one hundred foot lengths of electric cable with integral molded lighting fixtures are commonly use to provide illumination and to provide power (via a female outlet at one end) to one or more electrical tools. Such cables are often difficult to run through a worksite, and are particularly difficult to remove following such work, as quite often. This is typically because electrical cables with integral lighting are provided in one hundred foot standard lengths, which means that laying and retrieving cables used in the art is difficult because many obstacles such as t-bar style ceiling supports may interfere with such long cables. Moreover, hundred foot cables have only one possible female end, which limits their utility as a source of electrical power for tools and appliances at construction and other work sites.

What is needed, is a means to provide illumination and readily available electrical power connections throughout a worksite that can be easily disassembled upon completion of work or as work locations change within a site.

SUMMARY OF THE INVENTION

Accordingly, the inventor has conceived and reduced to practice, in a preferred embodiment of the invention, a construction lighting apparatus having a plurality of lighting modules, each comprising an electrical cord having approximately a 10 foot length, the electrical cord comprising an integral molded light source located midway, one end having a male electrical plug and the other end having a three-directional three-way female electrical outlet plug, the male electrical plug further having at least two pliable loops, the three-directional three-way female electrical outlet having at least two hooks. If two lighting modules are attached the pliable loops of the male electrical plug of one lighting module will be secured to the hooks of the three-directional three-way female electrical outlet of the other lighting module.

BRIEF DESCRIPTION OF THE DRAWING FIGURES

The accompanying drawings illustrate several embodiments of the invention and, together with the description, serve to explain the principles of the invention according to the embodiments. One skilled in the art will recognize that the particular embodiments illustrated in the drawings are merely exemplary, and are not intended to limit the scope of the present invention.

FIG. 1 is an illustration of a preferred embodiment of the invention.

DETAILED DESCRIPTION

The inventor has conceived, and reduced to practice, a multiterminal electrical cable 101 with an integral molded light fixture to address the deficiencies in the art noted above, as shown in FIG. 1. As shown, cable 101 comprises a first end having a standard male electrical connector 110 and two or more pliable loops 111 and a second end having a three-directional three-way female electrical outlet 120 having at least two hooks 121. Hooks 121 are adapted to secure a second cable's male end connector 110 to a first cable's female end connector 120 by coupling with and being secured by loops 111 associated with the second cable's male end 110, thus allowing chaining of multiple electrical cables 101 according to the invention in a construction or other similar work environment. In some embodiments, a hanger 132 is provided in a midsection of cable 101, optionally as an integral part of lighting fixture 130. Cable 101 also comprises an integral molded lighting fixture 130 usually coupled to a safety screen 131 that protects the bulb in lighting fixture 130. Electrical cables 101 with integral lighting fixtures 130, according to the invention, are easier to run in multiple directions because they typically will be approximately ten feet in length, thus enabling easy assembly and disassembly in work sites (where many obstacles are typically present). In the art, 150-foot continuous cables with lights are typically used, with the consequent problem that stringing such long cables in a construction or other worksite with many obstacles is difficult. Moreover, a common characteristic of such sites is that they change over time as work is completed, such that a 150-foot cable that may have been relatively easy to deploy is often very difficult to remove when work is complete, as new obstacles typically emerge during the life of a construction or other work project. Clearly the use of approximately 10-foot cables 101 of the invention, which can be conveniently chained together using the secure coupling of the male connectors 110 and the female connectors 120 via the loops 111 associated with the former and the hooks 121 associated with the latter. Moreover, in a preferred embodiment of the invention each female end further comprises a 3-way splitter 120 so that common electrical tools used at construction and other worksites can be powered easily throughout the site without the need for additional cabling. In addition, the use of 3-way splitters 120 allows cabling to be run in different directions, as may be required to provide area coverage of a worksite (as opposed to merely linear coverage from a single cable). Another advantage of the present invention is that, when a bulb of an integral molded light fixture 130 of one of the cables 101 of the invention blows out, only the single affected ten-foot cable 101 needs to be replaced, which is easily done because of the simple endpoint fittings described above; in the art, when bulbs blow out in 150-foot cables, they are usually ignored until a sufficient number have done so to make replacement of the entire 150-foot cable necessary.

Parts: 120-volt male plug, 10 feet of 12 gage extension type cord 101, 1 plastic molded medium base light bulb socket 130, plastic light bulb protective cage 131, 3-way 3-directional female splitter 120, reversed hooks 121 on the female splitter, rubber loops 111 attached to the male cord end 110.

Operation: male end 110 is plugged into a 120-volt receptacle which in turn energizes the foot extension cord type cord 101, illuminating light 130 in socket 131 in the center of 10-foot cord 101 energizing the 3 directional female splitter 120 at the other end allowing another 10-foot cord to be plugged in going in any one of the 3 directions and so forth; each pair of cables 101 being held together by the reversed hooks 121 and rubber loops 111.

The skilled person will be aware of a range of possible modifications of the various embodiments described above. Accordingly, the present invention is defined by the claims and their equivalents.

The invention claimed is:

1. A construction lighting apparatus, comprising:

a plurality of lighting modules, each of the lighting modules comprising an electrical cord having approximately a 10 foot length, the electrical cord comprising an integral molded light source located midway between a proximal end and a distal end of the electrical cord, the proximal end further having a male electrical plug and the distal end further having a three-directional three-way female electrical outlet plug, the male electrical plug further having at least two pliable loops, the three-directional three-way female electrical outlet further having at least two hooks;

wherein if a first lighting module is attached to a second lighting module the at least two pliable loops of the male electrical plug of the first lighting module will be secured to the at least two hooks of the three-directional three-way female electrical outlet of the second lighting module for the purpose of holding the male electrical plug of the first light module to the three-directional three-way female electrical outlet of the second lighting module.

2. A multiterminal electrical cable with an integral molded light, the cable comprising:

an insulated electrical cable of approximately ten feet in length and comprising an integral molded light source located midway between a proximal end and a distal end of the electrical cord;

a first end having a male electrical plug and at least two pliable loops;

a second end having a three-directional three-way female electrical outlet plug and at least two hooks;

wherein if a first multiterminal electrical cable is attached to a second multiterminal electrical cable the at least two pliable loops of the male electrical plug of the first multiterminal electrical cable will be secured to the at least two hooks of the three-directional three-way female electrical outlet of the second multiterminal electrical cable for the purpose of holding the male electrical plug of the first multiterminal electrical cable to the three-directional three-way female electrical outlet of the second multiterminal electrical cable.

* * * * *